US007949266B2

(12) United States Patent
Asakawa

(10) Patent No.: US 7,949,266 B2
(45) Date of Patent: May 24, 2011

(54) IMAGE FORMING APPARATUS WITH FUNCTION OF TONER SUPPLY AMOUNT CONTROL

(75) Inventor: Junko Asakawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 82 days.

(21) Appl. No.: 12/425,450

(22) Filed: Apr. 17, 2009

(65) Prior Publication Data

US 2009/0269087 A1 Oct. 29, 2009

(30) Foreign Application Priority Data

Apr. 24, 2008 (JP) ..... 2008-113978
Mar. 9, 2009 (JP) ..... 2009-055700

(51) Int. Cl.
*G03G 15/08* (2006.01)

(52) U.S. Cl. ..... 399/27

(58) Field of Classification Search ..... 399/9, 24, 399/25, 27–30, 58–60
See application file for complete search history.

(56) References Cited

U.S. PATENT DOCUMENTS 7,509,064 B2 * 3/2009 Kin et al. ..... 399/27
7,565,085 B2 * 7/2009 Okuyama et al. ..... 399/27
7,734,206 B2 * 6/2010 Ishida ..... 399/58
7,761,015 B2 * 7/2010 Wong ..... 399/27
7,770,987 B2 * 8/2010 Nakasendo ..... 347/5

FOREIGN PATENT DOCUMENTS

JP 2005-173296 6/2005

* cited by examiner

*Primary Examiner* — Hoan Tran
(74) *Attorney, Agent, or Firm* — IPUSA, PLLC

(57) ABSTRACT

An image forming apparatus transfers a toner image, which has been formed onto an image carrying member, to a printing medium. The image forming apparatus includes a sub-scan distance measuring part configured to measure a distance along a sub-scan direction from a predetermined position on the printing medium to a position at which the toner image is transferred to the printing medium; and a toner supplying amount control part configured to control, according to the distance measured by the sub-scan distance measuring part, a toner supplying amount used when the toner image is formed onto the image carrying member.

11 Claims, 10 Drawing Sheets

FIG.6

SET SWITCHING CRITERION

0: SUB-SCAN DISTANCE

1: TONER USED AMOUNT (NUMBER OF DOTS)

FIG.7

SET SUB-SCAN DISTANCE

SUB-SCAN DISTANCE: _____ mm

FIG.10

SET GRAPHIC MODE SUPPLYING RATE

GRAPHIC MODE SUPPLYING RATE: _____ %

FIG.12

| SET TONER USED AMOUNT (NUMBER OF DOTS) |
| --- |
| TONER USED AMOUNT (NUMBER OF DOTS): _____ (DOTS) |

FIG.13

| SET TONER SUPPLYING RATE |
| --- |
| TONER SUPPLYING RATE: _____ % |

IMAGE FORMING APPARATUS WITH FUNCTION OF TONER SUPPLY AMOUNT CONTROL

BACKGROUND OF THE INVENTION

1. Field of the Invention

The present invention relates to an image forming apparatus using an electrophotographic system such as a copier, a laser printer or a facsimile machine.

2. Description of the Related Art

As a developing unit used in an image forming apparatus of an electrophotographic system such as a copier, a facsimile machine or a printer, a developing unit in a toner concentration self control system is known in which toner concentration of two component developer including toner and magnetic particles used for developing an electrostatic latent image formed on an image carrying member is autonomously controlled, and toner concentration is kept to be a predetermined concentration.

In the developing unit in the toner concentration self control system, developer is charged before the developer is supplied to a developer carrying member, and the developer is not stirred in a longitudinal direction of the developer carrying member. As a result, in a case where a line which is parallel to a recording paper conveying direction (which is perpendicular to the longitudinal direction of the developer carrying member), a so-called longitudinal line, continues in an original image, a mixing rate (referred to as a toner rate, hereinafter) between toner and carrier of the developer decreases while the longitudinal line is being printed on recording paper. This is because, while the longitudinal line is being thus printed on the recording paper in the recording paper conveying direction, the developer on the developer carrying member does not move in the longitudinal direction of the developer carrying member to supplement consumed toner thus consumed to print the longitudinal line. As a result, image density may not be able to be kept at a backward portion of the recording paper in the recording paper conveying direction.

According to Japanese Laid-Open Patent Application No. 2005-173296, in an image forming apparatus having a two component developing unit in the toner concentration self control system, recording paper conveying intervals are adjusted according to a length of recording paper, and thus, a decrease in image density caused by toner rate reduction occurring when long recording paper is used is avoided.

However, when the recording paper conveying intervals are increased as an image is formed on long recording paper, a long time may be required for a printing process during which the image is formed on the recording paper and the recording paper is then ejected.

SUMMARY OF THE INVENTION

According to the present invention, an image forming apparatus transfers a toner image formed on an image carrying member to a printing medium. The image forming apparatus includes a sub-scan distance measuring part configured to measure a distance along a sub-scan direction from a predetermined position of the printing medium to a position at which the toner image is transferred to the printing medium; and a toner supplying amount control part configured to control, according to the distance measured by the sub-scan distance measuring part, a toner supplying amount used when the toner image is formed on the image carrying member.

According to another aspect of the present invention, an image forming apparatus transfers a toner image formed on an image carrying member to a printing medium. The image forming apparatus includes a toner used amount measuring part configured to measure a toner used amount used for forming the toner image on image carrying member; and a toner supplying amount control part configured to control, according to the toner used amount measured by the toner used amount measuring part, a toner supplying amount used when the toner image is formed on the image carrying member.

Other objects, features and advantages of the present invention will become more apparent from the following detailed description when read in conjunction with the accompanying drawings.

BRIEF DESCRIPTION OF THE DRAWINGS

FIG. 6 depicts one example of an operating page concerning the embodiment;

FIG. 7 depicts one example of an operating page for setting a sub-scan distance for switching a process carried out by the image forming apparatus in the embodiment;

FIGS. 9 and 10 depict examples of operating pages for setting a toner supplying amount for each printing mode concerning the embodiment;

FIG. 12 depicts one example of an operating page for setting a toner used amount for switching a process carried out by the image forming apparatus in the embodiment; and FIG. 13 depicts one example of an operating page for setting a toner supplying amount concerning the embodiment.

DESCRIPTION OF REFERENCE NUMERALS

Figure 1:
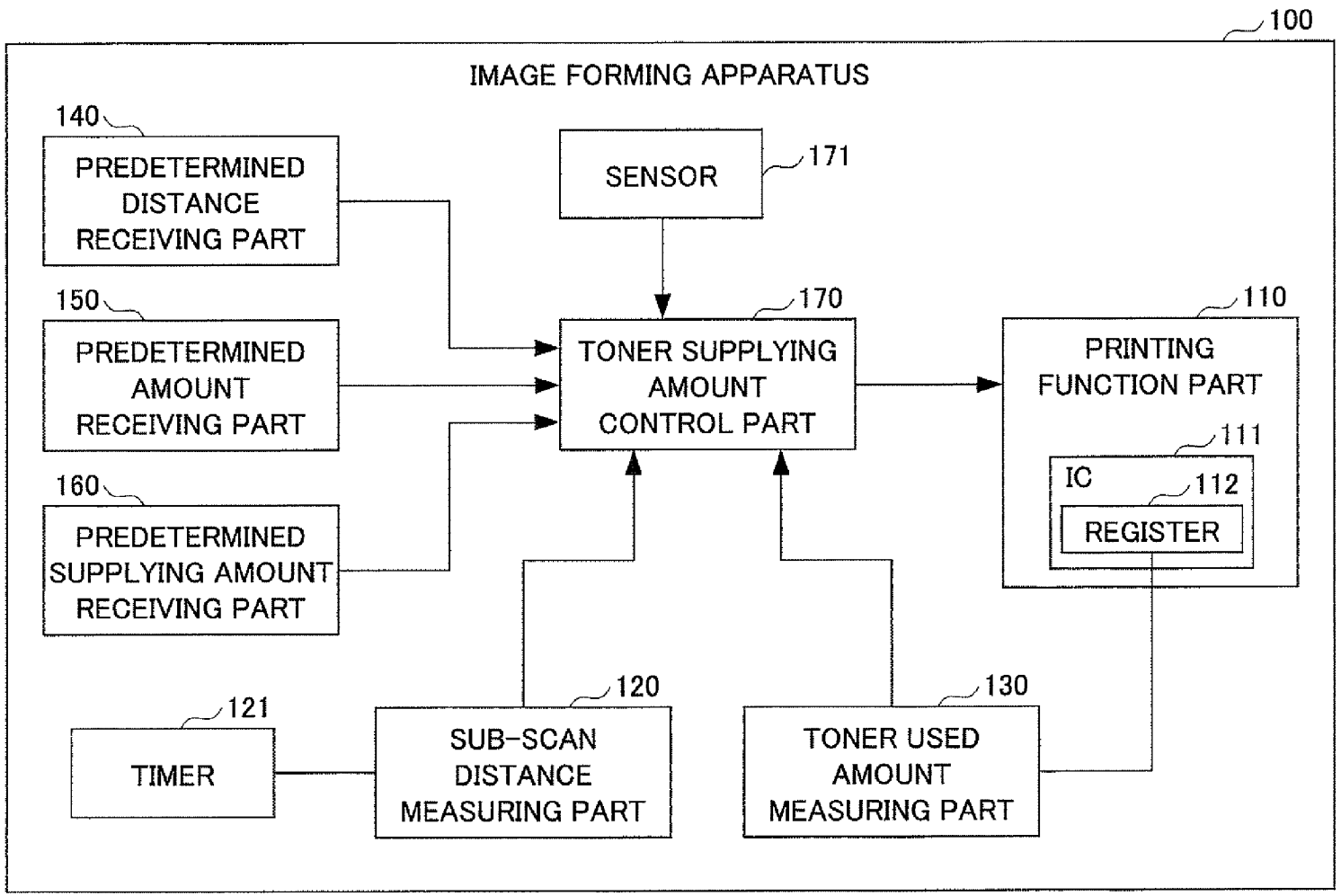
FIG. 1 illustrates an operation principle of an image forming apparatus in an embodiment.

1 paper feeding tray
2 paper feeding roller
3 separating roller
4 recording paper
5 conveying belt
6BK, 6M, 6C, 6Y image forming part
7 driving roller
8 following roller
9BK, 9M, 9C, 9Y photosensitive drum
10BK, 10M, IC, 10Y charger
11 exposure unit
12BK, 12M, 12C, 12Y developing unit
13BK, 13M, 13C, 13Y electricity removal unit
14BK, 14M, 14C, 14Y laser light of each image color
15BK, 15M, 15C, 15Y transferring unit

16 fixing unit
100 image forming apparatus
110 printing function part
111 IC
112 register
120 sub-scan distance measuring part
121 timer
130 toner used amount measuring part
140 predetermined distance receiving part
150 predetermined amount receiving part
160 predetermined supplying amount receiving part
170 toner supplying amount control part
171 sensor
210 CPU
220 ROM
230 RAM
240 flash memory
250 HDD
260 display device
270 scanner
280 plotter

DETAILED DESCRIPTION OF THE PREFERRED EMBODIMENT

An object of an embodiment is to provide an image forming apparatus in which a decrease in image density, which may occur when an image is formed on long recording paper, can be avoided, and toner consumption can be also controlled to an appropriate level.

A preferred embodiment will now be described with reference to the figures.

Operating Principle of Image Forming Apparatus in Embodiment

With reference to FIG. 1, an operating principle of an image forming apparatus in an embodiment will be described. FIG. 1 illustrates an operating principle of the image forming apparatus 100 in the embodiment. The image forming apparatus 100 includes a printing function part 110, a sub-scan distance measuring part 120, a toner used amount measuring part 130, a predetermined distance receiving part 140, a predetermined amount receiving part 150, a predetermined supplying amount receiving part 160 and a toner supplying amount control part 170. A timer 121 is further provided for the sub-scan distance measuring part 120, and will be described later. Further, an IC (Integrated Circuit) 111 is provided in the printing function part 110 to control writing of dots of an electrostatic latent image onto each of photosensitive drums, which will be described later with reference to FIG. 2. The IC 111 includes a register 112 which counts the number of dots having been formed on each photosensitive drum for the electrostatic latent image. Further, a sensor 171, which will be described later, is provided for the toner supplying amount control part 170.

The printing function part 110 carries out a regular printing process in the image forming apparatus 100. The regular printing process means a process of, for example, printing out an original image, which has been read by means of a scanner of the image forming apparatus 100, to paper by means of a plotter. In another example, image data which the image forming apparatus 100 obtains via a communication network such as a LAN (Local Area Network) is printed out by means of the plotter to paper. Operation of the printing function part 110 will be described in more detail. A description will be given for a case where image data of an original is printed to paper. The image data of an original may be one which is read by means of the scanner or may be one which is obtained via a communication network such as a LAN (Local Area Network). Further, a printing medium is paper in an example, but is not limited to paper.

Figure 2:
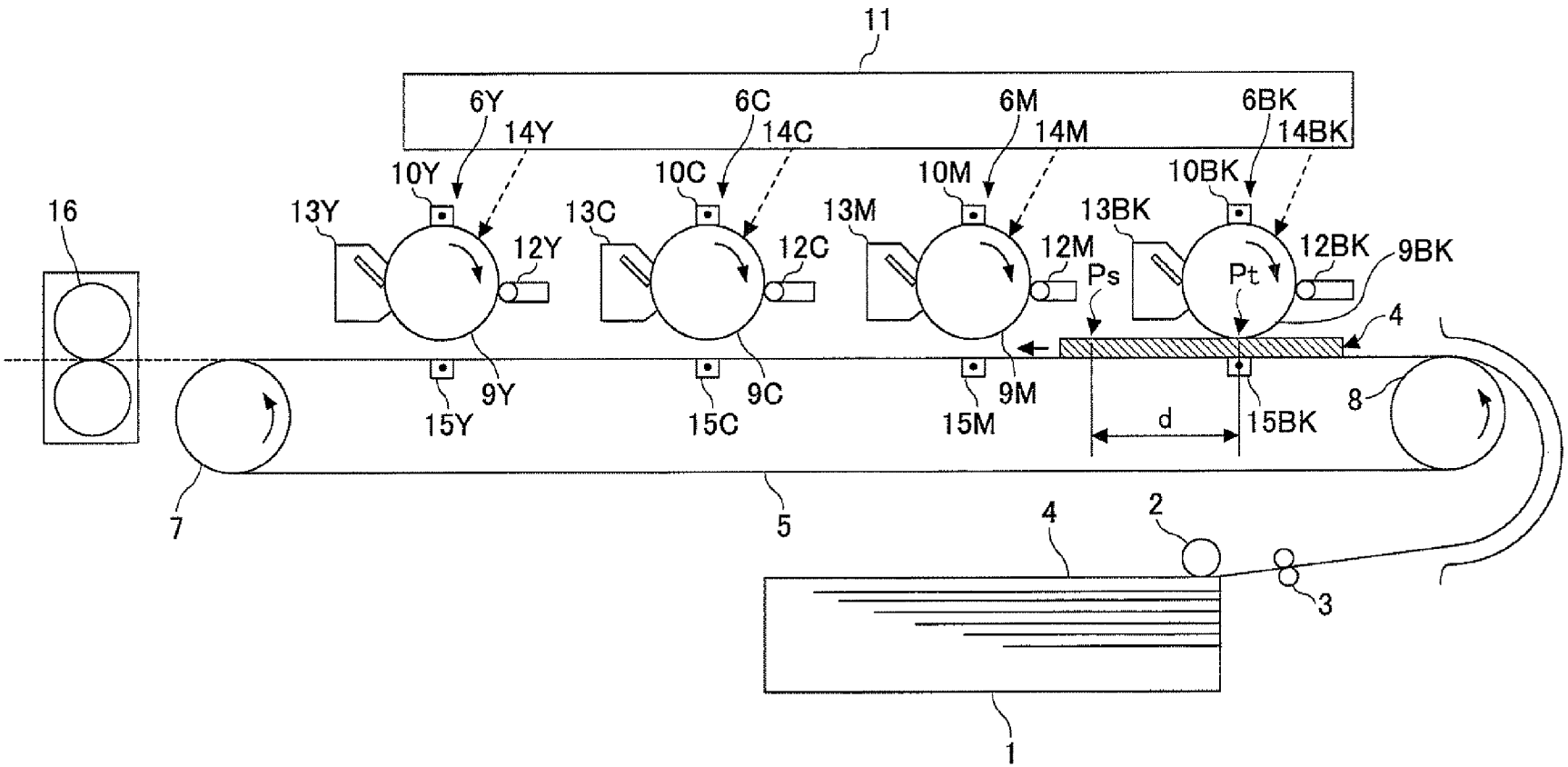
FIG. 2 illustrates a printing process of the image forming apparatus in the embodiment.

FIG. 2 depicts one example of a configuration of the printing function part 110 of the image forming apparatus 100. Here, a printing process of a tandem system in which a toner image of an original is directly transferred to recording paper will be described. However, the printing function part 110 may be one which carries out another printing process. The printing function part 110 includes a paper feeding tray 1, a paper feeding roller 2, separating rollers 3, recording paper 4, a conveying belt 5, image forming parts 6BK, 6M, 6C, 6Y, a driving roller 7, a following roller 8, photosensitive drums 9BK, 9M, 9C, 9Y, chargers 10BK, 10M, 10C, 10Y, an exposure unit 11, developing units 12BK, 12M, 12C, 12Y, electricity removal units 13BK, 13M, 13C, 13Y, transferring units 15BK, 15M, 15C, 15Y, and a fixing unit 16. The reference numerals 14BK, 14M, 14C, 14Y denote laser light or exposure beams of respective image colors, which will be described later.

The printing function part 110 is configured as depicted in FIG. 2, in which, along with the conveying belt 5, image forming parts 6BK, 6M, 6C and 6Y, forming images of respective image colors, i.e., a basic color, black (BK), and other colors, magenta (M), cyan (C) and yellow (Y), are arranged. That is, along with the conveying belt 5 which conveys paper (recording paper) 4, separated and fed by the paper feeding roller 2 and the separating rollers 3 from the paper feeding tray 1, the plurality of image forming parts 6BK, 6M, 6C, 6Y are arranged in the stated order from the upstream of the conveying direction of the conveying belt 5. The plurality of image forming parts 6BK, 6M, 6C, BY have a common internal configuration except that toners have different colors for forming respective toner images. Therefore, below, only respective components of the image forming part 6BK will be described. As to the other image forming parts 6M, 6C, 6Y, because operation is the same as that of the image forming part 6BK, duplicate description will be omitted.

The conveying belt 5 is an endless belt wound onto the driving roller 7 and the following roller 8. The driving roller 7 is driven by a driving motor. The driving motor (not depicted), the driving roller 7 and the following roller 8 function as a driving unit which moves the conveying belt 5 which is an endless moving unit.

When an image is to be formed, paper 4 held by the paper feeding tray 1 is fed one by one in sequence from the top of the paper feeding tray 1. By means of an electrostatic attraction function, the paper 4 is conveyed by the conveying belt 5 while being attracted to the conveying belt 5, which is driven and rotated, to the first image forming part 6BK. In the image forming part 6BK, a black toner image is formed which is then transferred to the paper 4.

The image forming part 6BK includes the photosensitive drum 9BK functions as a photosensitive member, and, the charger 10BK, the exposure unit 11, the developing unit 12BK, a photosensitive member cleaner (not depicted), the electricity removal unit 13BK and so forth, which are arranged around the photosensitive drum 9BK. The exposure unit 11 is configured to emit laser light 14BK, 14M, 14C, 14Y, i.e., exposure beams corresponding to image colors of the respective image forming parts 6BK, 6M, 6C, 6Y.

Figure 3:
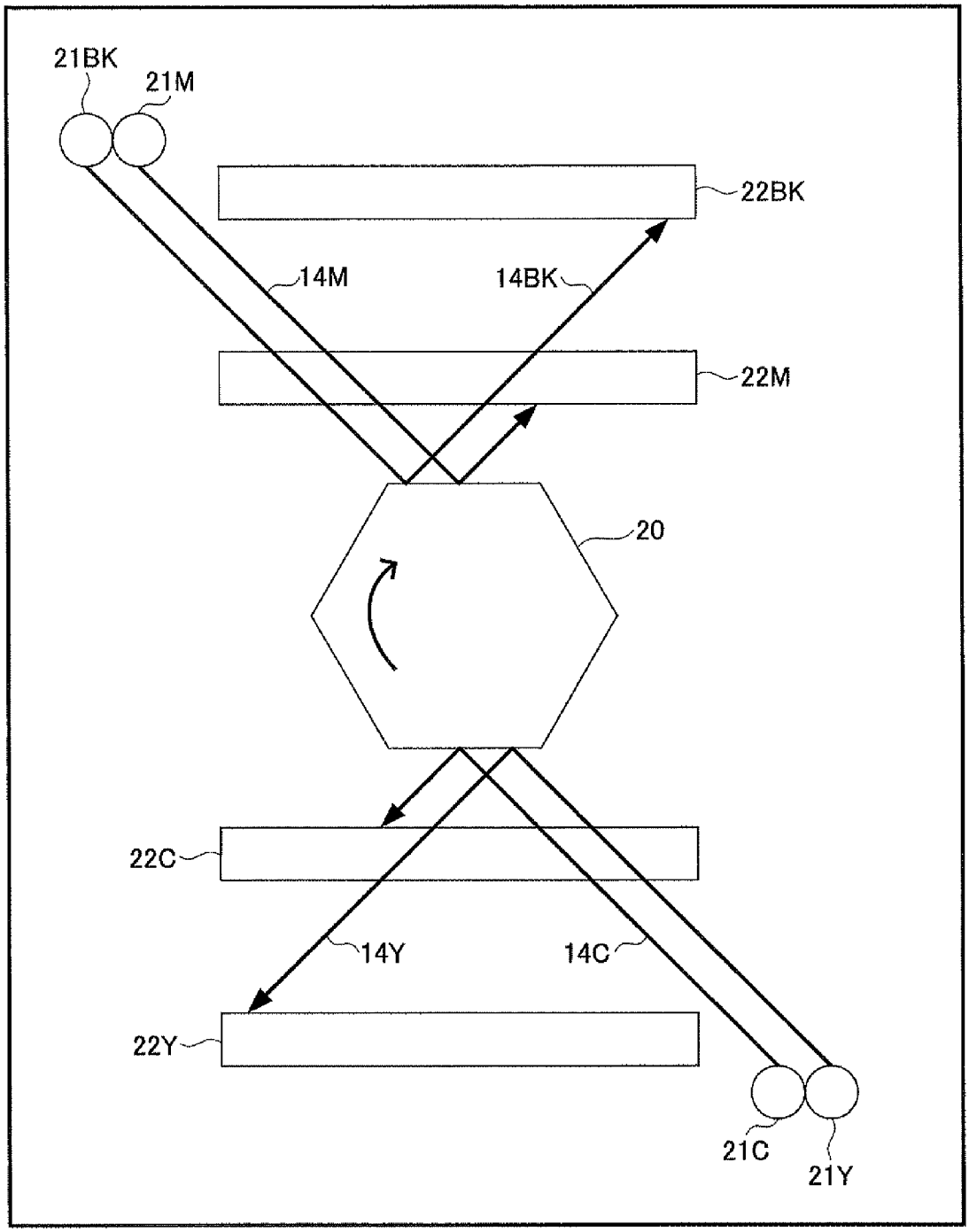
FIG. 3 depicts an internal view of an exposure unit in the embodiment.

The exposure unit 11 will now be described with reference to FIG. 3. FIG. 3 depicts an internal view of the exposure unit 11. Laser light 14BK, 14M, 14C, 14Y, i.e., exposure beams of the respective image colors, is emitted by respective laser diodes 21BK, 21M, 21C, 21Y which are light sources. The emitted laser light 141K, 14M, 14C, 14Y is bent by a reflecting mirror 20, and passes through optical systems 22BK, 22M, 22C, 22Y which adjust light paths. After that, the laser light 14BK, 14M, 14C, 14Y is used to scan the photosensitive drums 9BK, 9M, 9C, 9Y. The reflecting mirror 20 is a polygon mirror of a hexahedron. While being rotated, the reflecting mirror 20 can scan for one line in a main scan direction of the exposure beam per one surface of the polygon mirror. Further, the single polygon mirror is used commonly for the four laser diodes 21BK, 21M, 21C, 21Y as the light sources for scanning.

The exposure beams are separated to two groups each including two colors, i.e., laser light 14BK, 14M and laser light 14C, 14M, and then, scanning is carried out with the use of opposite reflecting surfaces of the polygon mirror. Thus, simultaneously, exposure of the four different photosensitive drums 9BK, 9M, 9C, 9Y can be carried out. The optical systems 22BK, 22C, 22M, 22Y include f-θ lenses which arrange reflected light at equal intervals, and deflection mirrors which deflect the laser light.

When an image is to be formed, an outer circumferential surface of the photosensitive drum 9BK is uniformly charged by the charger 10BK darkly. Then, the outer circumferential surface of the photosensitive drum 9BK is exposed by the laser light 14BK corresponding to a black toner image from the exposure unit 11, so that an electrostatic latent image is formed. The developing unit 12BK makes visible the electrostatic latent image with the use of black toner, to form a black toner image on the photosensitive drum 9BK. The black toner image is then transferred to the paper 4 by a function of the transferring unit 15BK at a position (transferring position) at which the photosensitive drum 9BK comes into contact with the paper 4 on the conveying belt 5. As a result of the transferring, the black toner image is formed on the paper 4.

The paper 4 on which the black toner image has been thus formed by the image forming part 6BK is conveyed to the next image forming part 6M by the conveying belt 5. The image forming part 6M forms a magenta toner image on the photosensitive drum 9M in the same process as the image forming process of the image forming part 6BK. The magenta toner image is transferred to the paper 4 to be overlaid on the black toner image having been formed on the paper 4 as mentioned above.

Further, the paper 4 is conveyed to the further next image forming parts 6C, 6Y, in sequence. Then, in the same operation, a cyan toner image formed on the photosensitive drum 9C and a yellow toner image formed on the photosensitive drum 9Y are transferred to the paper 4 to be overlaid on the existing toner image having been formed on the paper 4, in sequence. Thus, a full color image is formed on the paper 4. The paper 4 on which the full color image has been thus formed is then removed from the conveying belt 5, a fixing operation is carried out by the fixing unit 16 so that the full color image is fixed to the paper 4, and then, the paper 4 is ejected from the image forming apparatus 100.

The sub-scan distance measuring part 120 measures a distance "d" (referred to as a sub-scan distance) between a starting point position "Ps" of a printing medium 4 at which transfer of a toner image to the printing medium 4 has been started to a position "Pt" at which the toner image is currently transferred to the printing medium 4, when the toner image concerning an original image is transferred to the printing medium 4 and thus a printing process is carried out. For an illustrating purpose, FIG. 2 depicts a printing medium or paper 4 which currently passes below the photosensitive drum 9BK on the conveying belt 5. It is noted that, only for the illustrating purpose, the paper 4 is depicted as having an exaggerated thickness. However, actually, the paper 4 is so thin that the thickness of the paper 4 cannot be adequately depicted in FIG. 2. Thus, the sub-scan distance measuring part 120 obtains, indirectly, a toner used amount required for printing the original image, with the use of a distance at which the original image is actually printed. The measuring of the distance may be carried out in such a manner that the distance is measured based on a rotation speed of each of the photosensitive drums 9BK, 9M, 9C, 9Y. Alternatively, the measuring of the distance may be carried out in such a manner that the distance is measured based on a rotation speed of the conveying belt 5. Alternatively, measuring of the distance may be carried out in such a manner that a starting point position Ps of the printing medium 4 is actually detected, and a sensor which is provided is used to measure the distance d from the detected position Ps. It is noted that the starting point position Ps from which the sub-scan distance measuring part 120 measures the distance may be a position at which transferring of the toner image is started on the printing medium 4.

The toner used amount measuring part 130 measures a used amount of toner actually used for forming a toner image, when the toner image concerning an original image is transferred to a printing medium 4 and thus a printing process is carried out. In comparison to the above-mentioned sub-scan distance measuring part 120, the toner used amount measuring part 130 directly obtains a toner used amount required for printing an original image. The toner used amount measuring part 120 may measure a used amount of toner used in the developing units 12BK, 12M, 12C, 12Y. The toner used amount measuring part 120 may use another method to measure the toner used amount.

Further, the toner used amount measuring part 130 may measure the number of dots concerning an original image having been transferred to a printing medium 4, instead of directly measuring a toner used amount. By thus measuring the number of dots, a toner used amount required for printing the original image is indirectly measured. It is noted that, measuring of the number of dots may be carried out in such a manner that a toner amount used for forming each dot is not considered. Alternatively, measuring of the number of dots may be carried out in such a manner that a toner amount used for forming each dot is considered. For example of the above-mentioned method of considering a toner amount used for forming each dot, a method of counting dots may be changed according to the image density of image data.

The toner supplying amount control part 170 controls a toner supplying amount used when toner images are formed on the photosensitive drums 9BK, 9M, 9C, 9Y in the printing function part 110, according to a sub-scan distance measured by the sub-scan distance measuring part 120 or a toner amount (the number of dots) measured by the toner used amount measuring part 130. That is, when an original image is formed on recording paper having a long sub-scan distance (i.e., a long printing medium), image density may decrease because of a reduction in toner concentration for a backward portion of the long printing medium. Therefore, by appropriately controlling toner supplying amounts of the developing units 12BK, 12M, 12C and 12Y in a stage in which a printing process is proceeded with to some extent, it is possible to avoid a decrease in image density and it is possible to control toner consumption to an appropriate amount.

In the embodiment, a "toner supplying amount" is expressed by a time (milliseconds) per a predetermined unit time (milliseconds) during which toner is actually supplied to each of the developing units 12BK, 12M, 12C, 12Y from a corresponding toner cartridge (not depicted). It is noted that, in the embodiment, toner is supplied to each of the developing units 12BK, 12M, 12C, 12Y from the corresponding toner cartridge, as mentioned above, intermittently. More specifically, toner is supplied to each developing unit from the corresponding toner cartridge via through holes provided in the toner cartridge as a result of toner being stirred in the toner cartridge by a stirring mechanism driven intermittently. Only during each intermittent time in which the stirring mechanism stirs toner in the toner cartridge, is the toner supplied to the developing unit. In this regard, the toner supplying amount (milliseconds) means the sum total of the intermittent times per each predetermined unit time (milliseconds). For example, in a case where the predetermined unit time is T (milliseconds) and the sum total of the intermittent times per each predetermined unit time T is t (milliseconds), the toner supplying amount is t (milliseconds).

In this regard, a term "toner supplying rate", which will be described later, means a rate of the toner supplying amount (which is expressed by a time (milliseconds) as mentioned above) with respect to the predetermined unit time (milliseconds). That is, "toner supplying rate"="toner supplying amount" (ms)/"predetermined unit time"(ms)

In the above-mentioned example in which the predetermined unit time is T (milliseconds) and the sum total of the intermittent times per each predetermined unit time T is t (milliseconds), the toner supplying rate is t/T. The toner supplying rate may be expressed as a percentage (%), and thus, the toner supplying rate (%) may be expressed as t/T×100.

Further, the image forming apparatus 100 may have a plurality of printing modes according to characteristics of original images. The characteristics of original images are densities of images to be printed. For example, when an architectural designing drawing is printed, a density of an image is low. In contrast thereto, when a photograph is printed, the density of the image is high. When such a characteristic of an original image differs, a required toner amount differs even when an original image of the same area is printed. Therefore, in order to avoid a decrease in image density, and also, in order to control toner consumption to an appropriate amount, it is preferable to change a criterion in controlling a toner supplying amount carried out by the toner supplying amount control part 170 according to a characteristic of an original image. That is, it is preferable that the toner supplying amount control part 170 controls a toner supplying amount used when toner images of an original image are formed on the photosensitive drums 9BK, 9M, 9C, 9Y in the printing function part 110, according to both a sub-scan distance measured by the sub-scan distance measuring part 120 and a printing mode which is selected by an operator as mentioned later.

Further, when a sub-scan distance measured by the sub-scan distance measuring part 120 has reached a predetermined distance, the toner supplying amount control part 170 controls a toner supplying amount in such a manner that, a toner image of an original image is formed with a predetermined toner supplying amount for a backward portion from a position at which the sub-scan distance has reached the predetermined distance. Thus, a toner supplying amount is controlled appropriately based on the measured value of the sub-scan distance. As a result, it is possible to avoid a decrease in image density and also, it is possible to control toner consumption to an appropriate amount. Further, the toner supplying amount control part 170 may carry out the process with the predetermined distance and the predetermined toner applying amount provided for each of the above-mentioned printing modes.

Further, when a toner used amount measured by the toner used amount measuring part 130 has reached a predetermined amount, the toner supplying amount control part 170 controls a toner supplying amount in such a manner that, a toner image of an original image is formed with a predetermined toner supplying amount for a backward portion from a position at which the toner used amount has reached the predetermined distance. Thus, a toner supplying amount is controlled appropriately based on the measured value of the toner used amount. As a result, it is possible to avoid a decrease in image density and also, it is possible to control toner consumption to an appropriate amount.

Further, when the number of dots measured by the toner used amount measuring part 130 has reached a predetermined number of dots, the toner supplying amount control part 170 controls a toner supplying amount in such a manner that, a toner image of an original image is formed with a predetermined toner supplying amount for a backward portion from a position at which the number of dots has reached the predetermined number of dots. Thus, a toner supplying amount is controlled appropriately based on the number of dots which have been already printed. As a result, it is possible to avoid a decrease in image density and also, it is possible to control toner consumption to an appropriate amount.

Further, the predetermined distance for a sub-scan distance, the predetermined amount for a toner used amount, the predetermined number of dots and the predetermined toner supplying amount, which are used as parameters in the above-described control operation of the toner supplying amount control part 170, may be input from an operator of the image forming apparatus 100. Then, the toner supplying amount control part 170 may carry out the above-mentioned control operation with the use of the thus-received parameters. The predetermined distance receiving part 140 receives the predetermined distance for a sub-scan distance, input by the operator of the image forming apparatus 100 with the use of a display device or such. The predetermined amount receiving part 150 receives the predetermined amount for a toner used amount, or the predetermined number of dots, input by the operator of the image forming apparatus 100 with the use of the display device or such. The predetermined supplying amount receiving part 160 receives the predetermined toner supplying amount, input by the operator of the image forming apparatus 100 with the use of the display device or such. Thereby, the operator of the image forming apparatus 100 can set the parameters used by the toner supplying amount control part 170. As a result, it is possible to avoid a decrease in image density and it is possible to control toner consumption to an appropriate amount, according to benchmarks intended by the operator.

Below, a flow of a process of the image forming apparatus 100 will be described. Here, a process of printing an original image obtained from a scanner will be described. First, the predetermined distance receiving part 140 receives an input of the predetermined distance for a sub-scan distance from an operator. Further, the predetermined amount receiving part 150 receives an input of the predetermined amount for a toner used amount or the predetermined number of dots from the user. Further, the predetermined supplying amount receiving part 160 receives an input of the predetermined toner supplying amount from the operator. The predetermined distance receiving part 140 and the predetermined supplying amount receiving part 160 may receive the input from the operator for each of the printing modes which the image forming apparatus 100 has.

First, a case where the toner supplying amount control part 170 carries out a process based on a sub-scan distance measured by the sub-scan distance measuring part 120 will be described. The same as a regular printing process, the printing function part 110 carries out a printing process for an original image read by means of a scanner. In parallel to this process, the sub-scan distance measuring part 120 measures a sub-scan distance from a starting point position "Ps" of a printing medium 4 to a position "Pt" at which a toner image concerning the original image is being transferred, and notifies the toner supplying amount control part 170 of a measurement result.

Then, the toner supplying amount control part 170 compares the sub-scan distance transmitted from the sub-scan distance measuring part 120 and the predetermined distance received by the predetermined distance receiving part 140. Then, when the sub-scan distance transmitted from the sub-scan distance measuring part 120 has become equal to or larger than the predetermined distance, the toner supplying amount control part 170 carries out control such that a toner supplying amount used in the printing process carried out by the printing function part 110 is to be the predetermined toner supplying amount received by the predetermined supplying amount receiving part 160.

Next, a case where the toner supplying amount control part 170 carries out a process based on a toner used amount measured by the toner used amount measuring part 130 will be described. In the same manner as a regular printing process, the printing function part 110 carries out a printing process for an original image read by means of the scanner. In parallel to this process, the toner used amount measuring part 130 measures a toner used amount having been used for forming a toner image concerning the original image, and notifies the toner supplying amount control part 170 of a measurement result.

Then, the toner supplying amount control part 170 compares the toner used amount transmitted from the toner used amount measuring part 130 and the predetermined amount received by the predetermined amount receiving part 150. Then, when the toner used amount transmitted from the toner used amount measuring part 130 has become equal to or larger than the predetermined amount, the toner supplying amount control part 170 carries out control such that a toner supplying amount used in the printing process carried out by the printing function part 110 is to be the predetermined toner supplying amount received by the predetermined supplying amount receiving part 160.

Next, a case where the toner supplying amount control part 170 carries out a process based on the number of dots measured by the toner used amount measuring part 130 will be described. In the same manner as a regular printing process, the printing function part 110 carries out a printing process for an original image read by means of the scanner. In parallel to this process, the toner used amount measuring part 130 measures the number of dots concerning the original image having been formed on the printing medium 4, and notifies the toner supplying amount control part 170 of a measurement result.

Then, the toner supplying amount control part 170 compares the number of dots transmitted from the toner used amount measuring part 130 and the predetermined number of dots received by the predetermined amount receiving part 150. Then, when the number of dots transmitted from the toner used amount measuring part 130 has become equal to or larger than the predetermined number of dots, the toner supplying amount control part 170 carries out control such that a toner supplying amount used in the printing process carried out by the printing function part 110 is to be the predetermined toner supplying amount received by the predetermined supplying amount receiving part 160.

By each of the above-mentioned processes, in the image forming apparatus 100, the toner supplying amount is automatically switched according to a toner amount used in a printing process. Further, an operator can freely set the toner supplying amount. Therefore, it is possible to avoid decrease in image density even when an image is formed on a long recording paper, and also, it is possible to control toner consumption to an appropriate amount.

Hardware Configuration of Image Forming Apparatus in Embodiment

Figure 4:
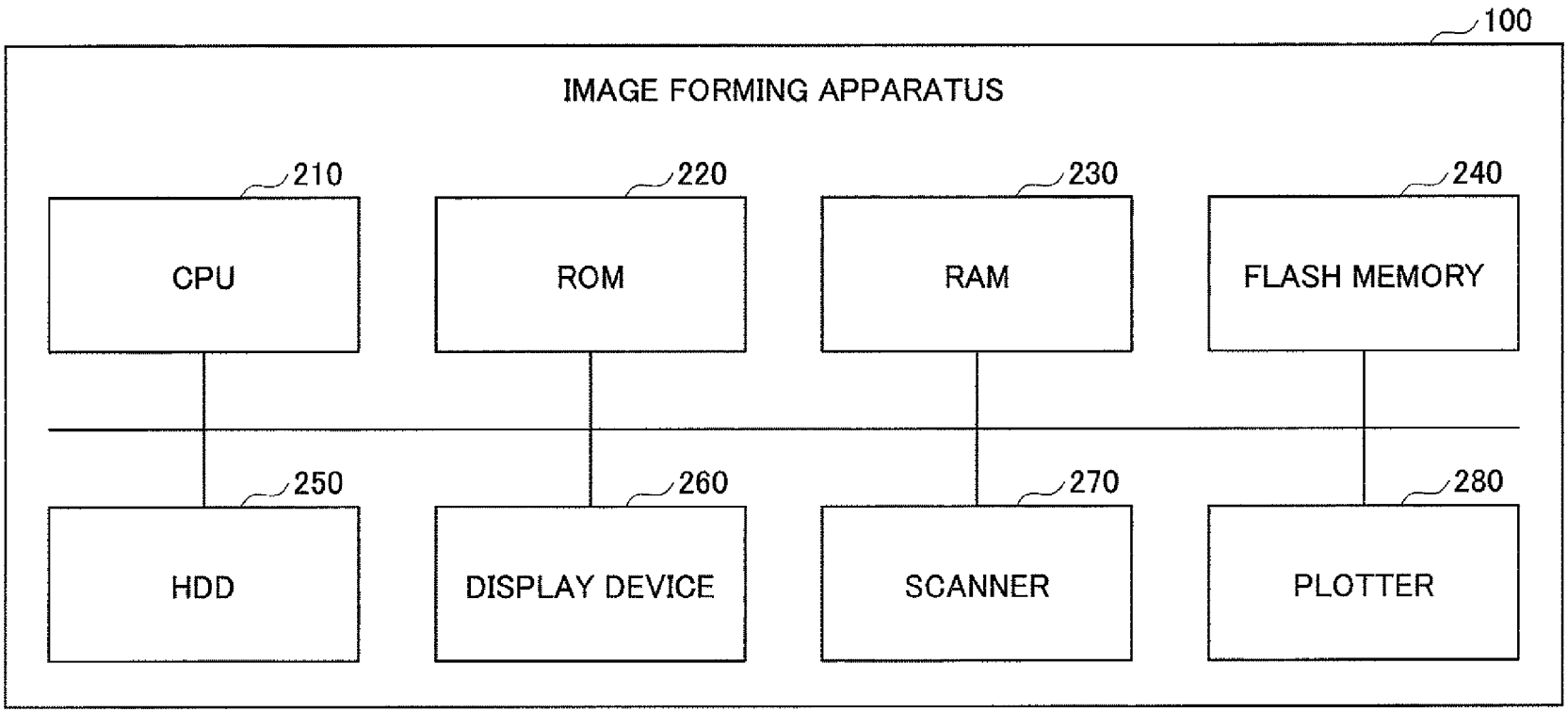
FIG. 4 depicts one example of a hardware configuration of the image forming apparatus in the embodiment.

With reference to FIG. 4, a hardware configuration of the image forming apparatus 100 in the embodiment will be described.

FIG. 4 depicts one example of a hardware configuration of the image forming apparatus 100 in the embodiment. The image forming apparatus 100 includes a CPU (Central Processing Unit) 210, a ROM (Read-Only Memory) 220, a RAM (Random Access Memory) 230, a flash memory 240, a HDD (Hard Disk Drive) 250, a display device 260, a scanner 270 and a plotter 280.

The CPU 210 is a device which executes a program stored in the ROM 220, carries out operation/calculation processes on data loaded on the ROM 230 according to instructions written in the program, and controls the entirety of the image forming apparatus 100. The ROM 220 stores programs to be executed by the CPU 210 and data. The RAM 230 is used for loading a program or data when the CPU 210 executes the program stored in the ROM 220, and for temporarily storing data being processed/calculated during the operation/calculation processes.

The flash memory 240 is a semiconductor memory in which data is kept even when power supply is interrupted. The flash memory 240 stores setup information and so forth. The HDD 250 is a device storing an OS (Operating System) which is basic software, application programs concerning the embodiment, plug-in software for extending functions, or such, together with associated data.

The display device 260 includes key switches and an LCD (Liquid Crystal Display). The display device 260 functions as a user interface used when an operator carries out various setups for utilizing functions of the image forming apparatus 100. The scanner 270 is a device for reading an original (or an original document), and inputting image data to the image forming apparatus 100. The plotter 280 is a device for outputting image data concerning an original to be printed out, to paper or a printing medium.

The respective parts of the image forming apparatus 100 depicted in FIG. 1 may be realized, and various processes described above and will be described with reference to FIGS. 5 through 13, may be carried out as a result of corresponding programs stored in the ROM 220 or the HDD 250 being executed by the CPU 210. Alternatively, the respective parts of the image forming apparatus 100 depicted in FIG. 1 may be realized, and various processes described above and will be described with reference to FIGS. 5 through 13 may be carried out, by means of corresponding hardware configurations provided.

Example of Process Carried Out by Image Forming Apparatus in Embodiment (1) Process for Switching Toner Supplying Rate Based on Sub-Scan Distance With reference to FIG. 5, one example of a process of printing an original image onto a long printing medium 4 by the image forming apparatus 100 in the embodiment will be described. Here, a process of printing an original image read by the scanner 270 to paper (as a printing medium 4) by the plotter 280 in the image forming apparatus 100 will be described. However, also for a case where image data obtained from a communication network such as a LAN is printed by the plotter 280, the same process may be applied. Further, the image forming apparatus 100 may change a control method according to a sub-scan distance concerning a printing medium 4, and here, a toner supplying rate may be changed instead of a toner supplying amount.

First, one example of a specific method for determining a toner supplying rate to be initially used will be described. That is, before actually carrying out a regular printing process in step S50, which will be described later, a toner supplying rate to be initially used is determined which is used for the printing process in step S50. The toner supplying rate to be initially used is determined by the toner supplying amount control part 170 with the used of a P pattern (i.e., a pattern of an electrostatic latent image) which is formed on each photosensitive drum, and is developed by means of the corresponding developing unit. A voltage Vsg at a background portion and a voltage Vsp at a pattern portion of the P pattern on the photosensitive drum are then measured by the above-mentioned sensor 171, and a rate Vsp/Vsg is obtained. As well-known, the voltage Vsp increases as toner density of the P pattern decreases, while, the voltage Vsp decreases as toner density of the P pattern increases. Then, above-mentioned rate Vsp/Vsg is used to determine the toner supplying rate to be initially used for the regular printing process to be carried out in step S50.

Figure 5:
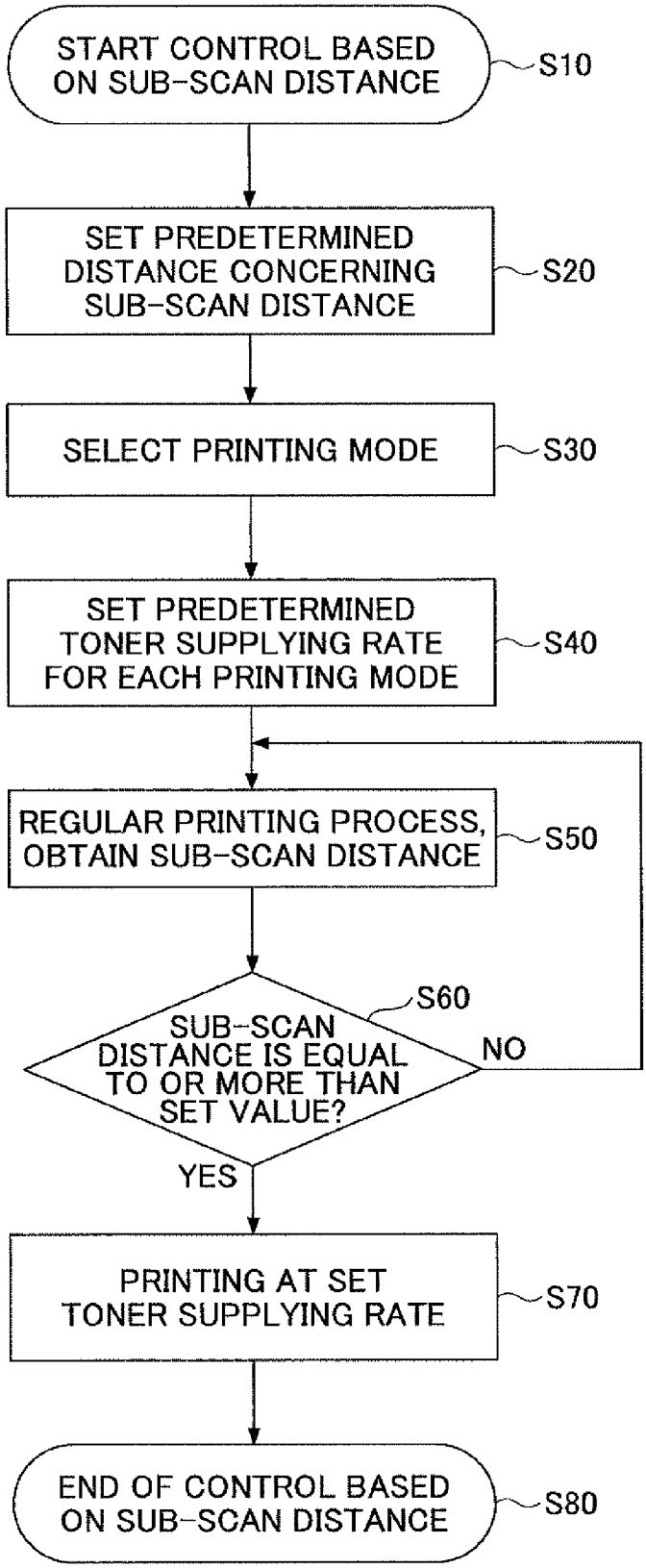
FIG. 5 depicts a flow chart of one example of a process based on a sub-scan distance in the image forming apparatus in the embodiment.

In FIG. 5, in step S10, the image forming apparatus 100 starts a process of switching a toner supplying rate based on a sub-scan distance. First, it is noted that the process of switching a toner supplying rate based on a sub-scan distance is carried out for each of the above-mentioned four colors, i.e., black (BK), magenta (M), cyan (C) and yellow (Y). It is noted that a toner supplying rate may be switched based on a sub-scan distance in an example of FIG. 5. However, an operator may select a criterion to switch a toner supplying rate as will be described later with reference to FIG. 6. Then, when the operator thus selects to switch a toner supplying rate based on a sub-scan distance, step S10 may be then carried out. On the other hand, when the operator thus selects to switch a toner supplying rate based on a toner used amount, step S100 of FIG. 11, which will be described later, may be then carried out, instead of step S10.

In step S20 of FIG. 5, the predetermined distance receiving part 140 displays an operating page such as that depicted in FIG. 7 on the display device 260, so that the operator can input a predetermined distance for switching a control method of a toner supplying rate. When the operator inputs a predetermined distance, the predetermined distance receiving part 140 receives this input. The predetermined distance received by the predetermined distance receiving part 140 is transmitted to the toner supplying amount control part 170.

Figure 8:
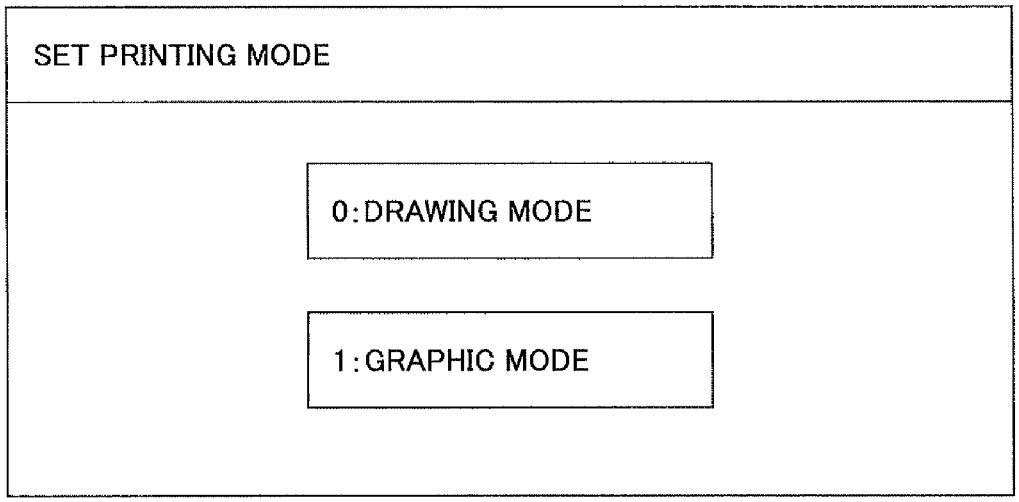
FIG. 8 depicts one example of an operating page for selecting a printing mode of the image forming apparatus in the embodiment.

In step S30, the image forming apparatus 100 displays an operating page such as that depicted in FIG. 8 on the display device 260, so that the operator can select a printing mode to be used for printing an original image. When the operator selects a printing mode, the printing mode is received by the image forming apparatus 100. It is noted that a printing mode may be set according to a density concerning an image to be printed out. For example, a density of an image is low when an architectural designing drawing is printed. On the other hand, when a photograph is printed out, a density of an image to be printed out is high. A "drawing mode" depicted in FIG. 8 represents a printing mode for printing out an image having a relatively low image density such as an architectural designing drawing. A "graphic mode" depicted in FIG. 8 represents a printing mode for printing out an image having a relatively high image density such as a photograph.

Figure 9:
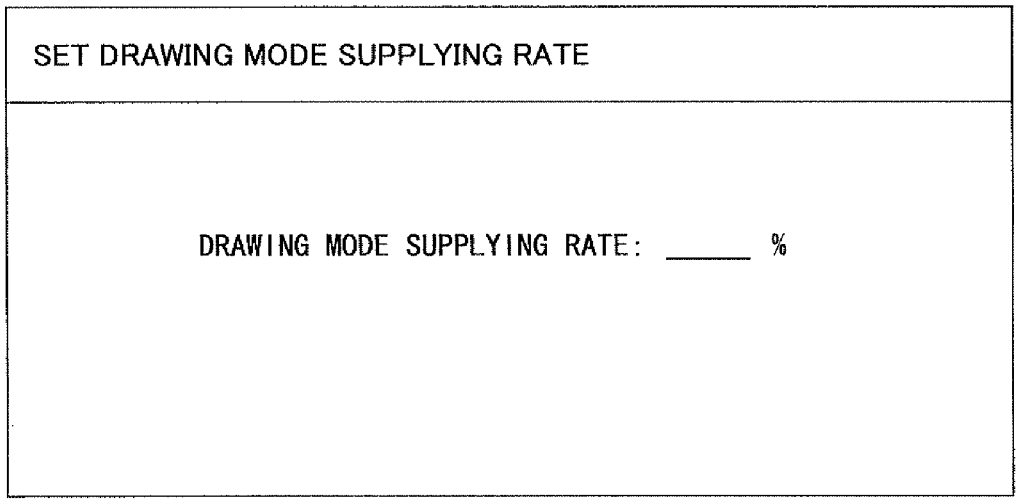

In step S40, the predetermined supplying amount receiving part 160 displays operating pages such as those depicted in FIGS. 9 and 10 on the display device 260, so that the operator can input a toner supplying rate (i.e., a predetermined toner supplying rate) to be used for a case where a sub-scan distance becomes equal to or larger than the predetermined distance. When the operator inputs the predetermined toner supplying rate, the predetermined supplying amount receiving part 160 receives the input predetermined toner supplying rate. As depicted in FIGS. 9 and 10, the predetermined supplying amount receiving part 160 receives the predetermined toner supplying rate to be used for each printing mode selected in step S30. This is because a toner amount required for printing an original image having the same area may differ when a characteristic of the original image differs as mentioned above. Therefore, in order to avoid a decrease in image density occurring when an image is formed on a long printing medium and to control toner consumption to an appropriate amount, a different amount of the predetermined toner supplying rate may be used according to a printing mode. The predetermined toner supplying rate thus received by the predetermined supplying amount receiving part 160 is transmitted to the toner supplying amount control part 170.

In step S50, the printing function part 110 carries out the regular printing process with the use of the toner supplying rate to be initially used determined by the toner supplying amount control part 170 as mentioned above with the use of the P pattern. Specifically, the scanner 270 obtains image data of an original image, the image forming parts 6BK, 6M, 6C, 6Y form toner images concerning the obtained image data onto the photosensitive drums 9BK, 9M, 9C, 9Y, the toner images are then transferred to a printing medium 4 conveyed by the conveying belt 5, and thus, a printing process concerning the original image is carried out.

In step S50, in parallel to the above-mentioned printing process, the sub-scan distance measuring part 120 measures a distance (i.e., a sub-scan distance) from a starting point position on the above-mentioned printing medium 4 at which transfer of the toner image to the printing medium 4 has been started to a position at which the toner image is currently being transferred to the printing medium 4, for each of the above-mentioned four colors, i.e., black (BK), magenta (M), cyan (C) and yellow (Y). The sub-scan distance measuring part 120 thus indirectly obtains a toner used amount required for printing the original image for each color of the above-mentioned four colors, with the use of the sub-scan distance for which the original image has been actually printed out.

It is noted that, measuring of the sub-scan distance may be carried out based on a peripheral speed of each of the photosensitive drums 9BK, 9M, 9C, 9Y. That is, the above-mentioned timer 121 depicted in FIG. 1 is used to measure a time elapsing from a time when forming of each color electrostatic latent image on the corresponding photosensitive drum is started to the current time. Then, by multiplying the thus-measured time and the peripheral speed of the photosensitive drum together, the sub-scan distance on the photosensitive drum is obtained. Then, a timing of actually using the thus-obtained sub-scan distance in step S50 may be delayed by a time required for the electrostatic latent image thus formed on the photosensitive drum being developed by the corresponding developing unit and then the thus-obtained toner image being transferred to the printing medium 4. As a result, it is possible to obtain the sub-scan distance of the toner image having been formed on the printing medium 4. Alternatively, measuring of the sub-scan distance may be carried out based on a peripheral speed of the conveying belt 5. In this case, by multiplying the above-mentioned measured time and the peripheral speed of the conveying belt 5 together, the sub-scan distance is obtained. Further alternatively, a sensor may be provided for actually detecting the starting point position of the printing medium 4 at which transfer of the toner image to the printing medium 4 is started, and then measuring the sub-scan distance from the thus-detected starting point position. The sub-scan distance thus measured by the sub-scan distance measuring part 120 is then transmitted to the toner supplying amount control part 170.

In step S60, the toner supplying amount control part 170 compares the sub-scan distance thus transmitted from the sub-scan distance measuring part 120 with the predetermined distance transmitted from the predetermined distance receiving part 140. Then, when the sub-scan distance is smaller than the predetermined amount (NO in step S60), the toner supplying amount control part 170 carries out control such that, the printing process concerning the original image is continued by the printing function part 110 in step S50, and the sub-scan distance measuring part 120 measures a sub-scan distance, and notifies the toner supplying amount control part 170 of a measurement result. In this case, the toner supplying rate to be initially used determined as mentioned above with the use of the P pattern is continuously used.

On the other hand, when the sub-scan distance is equal to or larger than the predetermined distance (YES in step S60), the toner supplying amount control part 170 carries out control in step S70 such that, a toner image concerning the original image is formed with the predetermined toner supplying rate, which is transmitted from the predetermined supplying amount receiving part 160. That is, in this case, the toner supplying amount control part 170 switches a control method concerning a toner supplying rate. More specifically, a toner supplying rate to be actually used for the printing process is switched from the toner supplying rate to be initially used, determined as mentioned above with the use of the P pattern, to the predetermined toner supplying rate.

In step S70, the image forming apparatus 100 finishes the printing process concerning the original image by means of the printing function part 110, and after that, finishes the process of switching a toner supplying rate based on a sub-scan distance.

Thus, a toner supplying rate (or a toner supplying amount) is appropriately controlled based on a measured value of a sub-scan distance, and as a result, it is possible to avoid a decrease in image density at a backward portion of a long printing medium, and also, it is possible to control toner consumption to an appropriate amount.

(2) Process for Switching Toner Supplying Rate Based on Toner Used Amount

Figure 11:
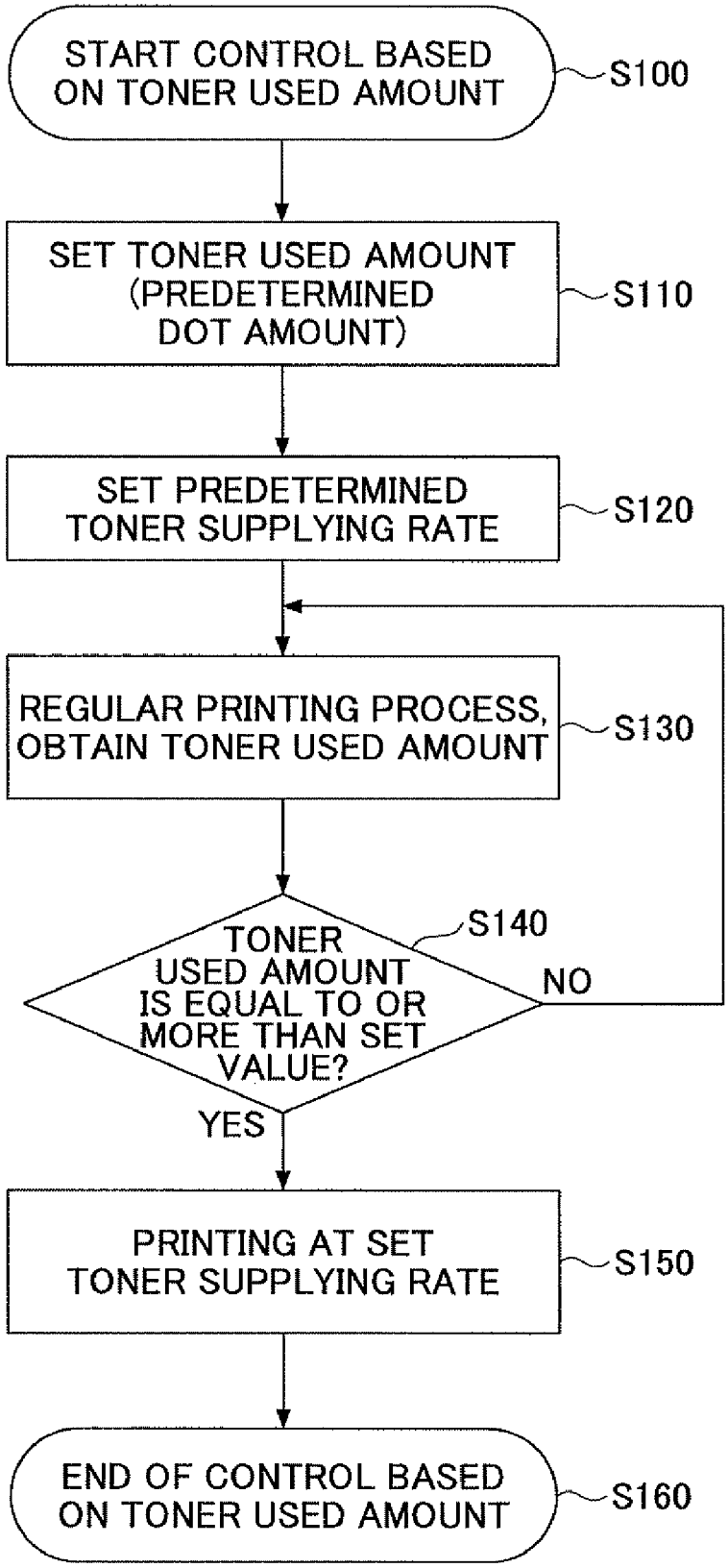
FIG. 11 depicts a flow chart of one example of a process based on a toner used amount in the image forming apparatus in the embodiment.

With reference to FIG. 11, another example of a process of printing an original image onto a long printing medium 4 by the image forming apparatus 100 in the embodiment will be described. Here, a process of printing an original image read by the scanner 270 to paper (as a printing medium 4) by the plotter 280 in the image forming apparatus 100 will be described. However, also for a case where image data obtained from a communication network such as a LAN is printed by the plotter 280, the same process can be applied. Further, the image forming apparatus 100 changes a control method according to a toner used amount used when each color toner image is formed on a printing medium 4, and here, a toner supplying rate may be changed instead of a toner supplying amount.

Before actually carrying out a regular printing process in step S130, a toner supplying rate to be initially used is determined by the toner supplying amount control part 170. The toner supplying rate to be initially used is determined with the used of a P pattern which is formed on each photosensitive drum, and is developed by means of the corresponding developing unit. A voltage Vsg at a background portion and a voltage Vsp at a pattern portion of the P pattern on the photosensitive drum are measured by the above-mentioned sensor 171, and a rate Vsp/Vsg is obtained. Then, the rate Vsp/Vsg is used to determine the toner supplying rate to be initially used for the regular printing process to be carried out in step S130.

In FIG. 11, in step S100, the image forming apparatus 100 starts a process of switching a toner supplying rate based on a toner used amount. First, it is noted that the process of switching a toner supplying rate based on a toner used amount is carried out for each of the above-mentioned four colors, i.e., black (BK), magenta (M), cyan (C) and yellow (Y). It is noted that a toner supplying rate may be switched based on a toner used amount in an example of FIG. 11. However, an operator may select a criterion to switch a toner supplying rate as having been described above with reference to FIG. 6. Then, when the operator thus selects to switch a toner supplying rate based on a toner used amount, step S100 may be then carried out.

In step S110 of FIG. 11, the predetermined amount receiving part 150 displays an operating page such as that depicted in FIG. 12 on the display device 260, so that the operator can input a predetermined toner used amount for switching a control method of a toner supplying rate. When the operator inputs a predetermined toner used amount, the predetermined amount receiving part 150 receives this input. The predetermined toner used amount received by the predetermined amount receiving part 150 is transmitted to the toner supplying amount control part 170. Further, as depicted in FIG. 12, the predetermined amount receiving part 150 may display an operating page such as that depicted in FIG. 12 on the display device 260, so that the operator can input a predetermined number of dots, instead of a predetermined toner used amount, for switching a control method of a toner supplying rate. When the operator inputs a predetermined number of dots, the predetermined amount receiving part 150 receives this input. Then, the predetermined number of dots received by the predetermined amount receiving part 150 is transmitted to the toner supplying amount control part 170.

In step S120, the image forming apparatus 100 displays an operating page such as that depicted in FIG. 13 on the display device 260, so that the operator can input a toner supplying rate (i.e., a predetermined toner supplying rate) to be used for a case where a toner used amount becomes equal to or larger than the predetermined amount, or the number of dots concerning the original image formed on the printing medium 4 becomes equal to or larger than the predetermined number of dots. When the operator inputs the predetermined toner supplying rate, the predetermined supplying amount receiving part 160 receives the input predetermined toner supplying rate. The predetermined toner supplying rate thus received by the predetermined supplying amount receiving part 160 is notified of to the toner supplying amount control part 170.

In step S130, the printing function part 110 carries out the regular printing process with the use of the above-mentioned toner supplying rate to be initially used determined with the use of the P pattern mentioned above. Specifically, the scanner 270 obtains image data of an original image, the image forming parts 6BK, 6M, 6C, 6Y form toner images concerning the obtained image data onto the photosensitive drums 9BK, 9M, 9C, 9Y, the toner images are then transferred to a printing medium 4 conveyed by the conveying belt 5, and thus, a printing process concerning the original image is carried out.

In step S130, in parallel to the above-mentioned printing process, the toner used amount measuring part 130 measures a toner used amount having been used for forming the corresponding color toner image on each of the photosensitive drums 9BK, 9M, 9C, 9Y. For this purpose, the toner used amount measuring part 130 may measure a toner used amount having been used in each of the developing units 12BK, 12M, 12C, 12Y for forming the corresponding color toner image on the corresponding photosensitive drum. One example of a specific method for measuring a toner used amount having been used in each of the developing units 12BK, 12M, 12C, 12Y for forming the corresponding color toner image on the corresponding photosensitive drum is as follows: That is, by multiplying together the toner supplying amount (which is expressed by a time (milliseconds) as mentioned above) and a unit toner supply rate (grams/millisecond), which is actually supplied to the corresponding developing unit per one millisecond, the toner used amount (grams) per each predetermined unit time is obtained. Then, by summarizing the thus-obtained toner used amount per each predetermined unit time for a time during which the toner image has been formed on each photosensitive drum, the toner used amount (grams) to be used in step S130 is obtained. Another method may be used by the toner used amount measuring part 130.

Further, in step S130, the toner used amount measuring part 130 may measure the number of dots of the toner image having been formed on the printing medium 4, instead of measuring a toner used amount having been used in each of the developing units 12BK, 12M, 12C, 12Y for forming the corresponding color toner image on the corresponding photosensitive drum as mentioned above. By measuring the number of dots of each color toner image having been formed on the printing medium 4, it is possible to indirectly measure a toner used amount required for printing the original image. Measuring of the number of dots may be carried out without considering a toner amount used for forming each dot. Alternatively, measuring of the number of dots may be carried out in consideration of a toner amount used for forming each dot. One example of a specific method for measuring the number of dots is as follows: The above-mentioned register 112 of the IC 111 of the printing function part 110 depicted in FIG. 1 is read, and thus, the number of dots having been formed on the corresponding photosensitive drum as an electrostatic latent image is obtained. Then, a timing of actually using the thus-obtained number of dots in step S130 may be delayed by a time required for the electrostatic latent image thus formed on the photosensitive drum being developed by the corresponding developing unit and then the thus-obtained toner image being transferred to the printing medium 4. As a result, it is possible to obtain the number of dots having been formed on the printing medium 4.

The toner used amount or the number of dots thus measured by the toner used amount measuring part 130 is transmitted to the toner supplying amount control part 170.

In step S140, the toner supplying amount control part 170 compares the toner used amount or the number of dots thus transmitted from the toner used amount measuring part 130 with the predetermined amount or the predetermined number of dots notified of from the predetermined amount receiving part 150. Then, when the toner used amount or the number of dots is smaller than the predetermined amount or the predetermined number of dots (NO in step S140), the toner supplying amount control part 170 carries out control such that, the printing process concerning the original image is continued by the printing function part 110 in step S130, and the sub-scan distance measuring part 120 measures a toner used amount or the number of dots, and notifies the toner supplying amount control part 170 of a measurement result. In this case, the above-mentioned toner supplying rate to be initially used, determined with the use of the P pattern, is continuously used.

On the other hand, when the toner used amount or the number of dots is equal to or larger than the predetermined amount or the predetermined number of dots (YES in step S140), the toner supplying amount control part 170 carries out control in step S150 such that, a toner image concerning the original image is formed with the predetermined toner supplying rate, which is transmitted from the predetermined supplying amount receiving part 160. That is, in this case, the toner supplying amount control part 170 switches a control method concerning a toner supplying rate. That is, a toner supplying rate to be actually used for the printing process is switched from the toner supplying rate to be initially used determined with the use of the P pattern into the predetermined toner supplying rate.

In step S160, the image forming apparatus 100 finishes the printing process concerning the original image by means of the printing function part 110, and after that, finishes the process of switching a toner supplying rate based on a toner used amount.

Thus, a toner supplying rate (or a toner supplying amount) is appropriately controlled based on a measured value of a toner used amount or the number of dots and as a result, it is possible to avoid a decrease in image density at a backward portion of a long printing medium, and also, it is possible to control toner consumption to an appropriate amount.

SUMMARY

In the image forming apparatus 100 in the embodiment, a toner supplying amount or a toner supplying rate is automatically switched according to a toner amount used for forming an image, and the toner supplying amount or the toner supplying rate may be freely set by an operator (or a user). Therefore, it is possible to avoid a decrease in image density when an image is formed on a long printing medium, and also, it is possible to control toner consumption to an appropriate amount.

The present invention is not limited to the specifically disclosed embodiments, and variations and modifications may be made without departing from the scope of the present invention.

The present application is based on Japanese priority applications Nos. 2008-113978 and 2009-055700, filed Apr. 24, 2008 and Mar. 9, 2009, respectively, the entire contents of which are hereby incorporated herein by reference.

What is claimed is:

1. An image forming apparatus which transfers a toner image, which has been formed on an image carrying member, to a printing medium, the image forming apparatus comprising:

a sub-scan distance measuring part configured to measure a distance along a sub-scan direction from a predetermined position of the printing medium to a position at which the toner image is transferred to the printing medium; and a toner supplying amount control part configured to control, according to the distance measured by the sub-scan distance measuring part, a toner supplying amount used when the toner image is formed on the image carrying member.

2. The image forming apparatus as claimed in claim 1, wherein:

a plurality of printing modes are prepared for different characteristics of original images; and the toner supplying amount control part controls the toner supplying amount according to the distance measured by the sub-scan distance measuring part and a printing mode.

3. The image forming apparatus as claimed in claim 1, wherein:

the toner supplying amount control part controls the toner supplying amount to be a predetermined toner supplying amount for forming the toner image when the distance measured by the sub-scan distance measuring part becomes equal to or longer than a predetermined distance.

4. The image forming apparatus as claimed in claim 3, further comprising:

a predetermined distance receiving part configured to receive from an operator an input for setting the predetermined distance.

5. The image forming apparatus as claimed in claim 4, further comprising:

a predetermined supplying amount receiving part configured to receive from an operator an input for setting the predetermined toner supplying amount.

6. The image forming apparatus as claimed in claim 3, further comprising:

a predetermined supplying amount receiving part configured to receive from an operator an input for setting the predetermined toner supplying amount.

7. An image forming apparatus which transfers a toner image, which has been formed on an image carrying member, to a printing medium, the image forming apparatus comprising:

a toner used amount measuring part configured to measure a toner used amount used for forming the toner image; and a toner supplying amount control part configured to control, according to the toner used amount measured by the toner used amount measuring part, a toner supplying amount used when the toner image is formed on the image carrying member, wherein:

the toner supplying amount control part controls the toner supplying amount to be a predetermined toner supplying amount for forming the toner image when the toner used amount measured by the toner used amount measuring part becomes equal to or larger than a predetermined amount.

8. The image forming apparatus as claimed in claim 7, wherein:

the toner used amount measuring part measures the number of dots concerning the toner image transferred to the printing medium.

9. The image forming apparatus as claimed in claim 7, further comprising:

a predetermined amount receiving part configured to receive from an operator an input for setting the predetermined amount.

10. The image forming apparatus as claimed in claim 9, further comprising:

a predetermined supplying amount receiving part configured to receive from an operator an input for setting the predetermined toner supplying amount.

11. The image forming apparatus as claimed in claim 7, further comprising:

a predetermined supplying amount receiving part configured to receive from an operator an input for setting the predetermined toner supplying amount.

* * * * *